US011557824B2

(12) United States Patent
Wang et al.

(10) Patent No.: US 11,557,824 B2
(45) Date of Patent: Jan. 17, 2023

(54) ANTENNA MOUNTING DEVICE AND BASE STATION ANTENNA SYSTEM

(71) Applicant: CommScope Technologies LLC, Hickory, NC (US)

(72) Inventors: Zhigang Wang, Jiangsu (CN); PuLiang Tang, Jiangsu (CN); Ruixin Su, Jiangsu (CN); Maosheng Liu, Jiangsu (CN); Nengbin Liu, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 14 days.

(21) Appl. No.: 17/319,311

(22) Filed: May 13, 2021

(65) Prior Publication Data

US 2021/0367320 A1 Nov. 25, 2021

(30) Foreign Application Priority Data

May 21, 2020 (CN) ..... 202020868312.5

(51) Int. Cl.
*H01Q 1/12* (2006.01)
*H01Q 1/24* (2006.01)

(52) U.S. Cl.
CPC ..... *H01Q 1/125* (2013.01); *H01Q 1/246* (2013.01)

(58) Field of Classification Search
CPC ..... H01Q 1/125; H01Q 1/1264; H01Q 1/246
See application file for complete search history.

(56) References Cited

U.S. PATENT DOCUMENTS

2014/0103184 A1* 4/2014 Asrokin ..... H01Q 1/1228 248/514
2020/0259248 A1* 8/2020 Lv ..... H01Q 21/061

FOREIGN PATENT DOCUMENTS

CN 203071233 U * 7/2013 ..... H01Q 21/00
CN 207994074 U * 10/2018 ..... H01Q 1/125

* cited by examiner

*Primary Examiner* — Hoang V Nguyen
(74) *Attorney, Agent, or Firm* — Myers Bigel, P.A.

(57) ABSTRACT

The present disclosure relates to an antenna mounting device and a base station antenna system. The antenna mounting device includes a hinge device and an adjustment arm. The hinge device is configured to be mounted to a pole by a clamp and configured to pivotally connect a base station antenna arrangement. The adjustment arm is configured to be mounted to the pole by a clamp and configured to connect the base station antenna arrangement. The connection of the hinge device with the base station antenna arrangement is located in a middle region of a longitudinal extension of the base station antenna arrangement [having a longitudinal extension] of a maximum of ⅓ of the longitudinal extension of the base station antenna arrangement. A connection of the adjustment arm with the base station antenna arrangement is located in one of two end regions of the base station antenna arrangement. The adjustment arm has a plurality of connection positions for the corresponding clamp, which are configured to define a plurality of different mechanical tilt angles of the base station antenna arrangement about the hinge device. The antenna mounting device realizes easy adjustment of the mechanical tilt angle and good resistance against external disturbance loads.

15 Claims, 3 Drawing Sheets

ANTENNA MOUNTING DEVICE AND BASE STATION ANTENNA SYSTEM

RELATED APPLICATION

The present application claims priority from and the benefit of Chinese Utility Model Application No. 202020868312.5, filed May 21, 2020, the disclosure of which is hereby incorporated herein in its entirety.

FIELD OF THE INVENTION

The present disclosure generally relates to the field of wireless communication. In particular, the present disclosure relates to an antenna mounting device and a base station antenna system including such an antenna mounting device.

BACKGROUND OF THE INVENTION

In a wireless communication system, signal transmission and reception are realized by base station antennas. The position of the base station antenna is important for the wireless communication network, which will affect the coverage of the base station antenna. Therefore, in the process of installing and using the base station antenna, the position of the base station antenna may need to be adjusted accordingly, so that the coverage area of the base station antenna can meet the requirements. With the rapid development of wireless communication networks (such as 4G and 5G networks), in some cases, multiple base station antennas of the same or different types need to be mounted together to realize different functions. These multiple base station antennas of the same or different types may also need to work together, so in some cases it is desirable to be able to jointly adjust their positions during use, such as mechanical tilt angles.

Typically, the antenna mounting device may include an adjustment device mounted above and a hinge device mounted below. The base station antenna can pivot around the hinge device, and the adjustment device can limit the pivot angle or mechanical tilt angle of the base station antenna. In some known antenna mounting devices, the adjustment device is configured as a V-shaped structure having two arms hinged to each other. The opening angle of the V-shaped structure determines the mechanical tilt angle of the base station antenna. In particular, when the V-shaped structure is almost closed, its resistance to external disturbance loads such as strong wind is unfavorable. In addition, due to the force from the weight of the base station antenna, the adjustment of the mechanical tilt angle of the base station antenna is costly.

SUMMARY OF THE INVENTION

A purpose of the present disclosure is to provide an antenna mounting device and a base station antenna system including the antenna mounting device, which, compared with the prior art, realizes easy adjustment of the mechanical tilt angle of the base station antenna arrangement and high stability against external disturbance loads.

According to one aspect of the present disclosure, an antenna mounting device is proposed. The antenna mounting device includes a hinge device configured to be mounted to a pole by a clamp and configured to pivotally connect a base station antenna arrangement; and an adjustment arm configured to be mounted to the pole by a clamp and configured to connect the base station antenna arrangement;

wherein a connection of the hinge device with the base station antenna arrangement is located in a middle region of a longitudinal extension of the base station antenna arrangement having a longitudinal extension of a maximum of ⅓, such as ¼ or ⅕, of the longitudinal extension length of the base station antenna arrangement; and a connection of the adjustment arm with the base station antenna arrangement is located in one of two end regions of the base station antenna arrangement; wherein the adjustment arm has a plurality of connection positions for the corresponding clamp, which are configured to define a plurality of different mechanical tilt angles of the base station antenna arrangement about the hinge device.

The beneficial technical effects of the present disclosure may include a simple structure of the antenna mounting device that enables easy adjustment of the mechanical tilt angle of the base station antenna arrangement with stability in place, thereby reducing the maintenance load of the base station antenna arrangement and improving the service life of the base station antenna arrangement.

In addition, compared to the adjustment device of the prior art, the structure of the adjustment arm can be simpler and its size can be more compact.

Here, the middle region can be understood as a region symmetrical from the center point of the longitudinal extension of the base station antenna arrangement. Therefore, the expression "the middle region has a longitudinal extension of ⅓ of the longitudinal extension length of the base station antenna arrangement" means that the middle region has a radius from the center point, which is equivalent to ⅙ of the longitudinal extension length of the base station antenna arrangement.

In some embodiments, the adjustment arm may have an elongated hole with protrusions distributed in at least one of its longitudinal sides, which divide the elongated hole into the plurality of connection positions.

In some embodiments, the elongated hole may have protrusions opposite each other on two longitudinal sides thereof.

In some embodiments, the protrusions on each longitudinal side may be distributed uniformly.

In some embodiments, the adjustment arm may have two side walls spaced apart from each other, with each side wall having the elongated hole.

In some embodiments, each side wall may be connected to a corresponding clamp in one of the connection positions of the elongated hole by a separate connection device, such as a bolt connection device, a pinhole connection device, or a rivet connection structure.

In some embodiments, the connection device may include a positioning member that is movable into and out of one of the connecting positions of the elongated hole, wherein the adjustment arm is connected with the corresponding clamp when the positioning member moves into this connecting position, and the adjustment arm is released from the corresponding clamp when the positioning member moves out of this connecting position.

In some embodiments, the bolt connection device may include: a bolt with a bolt rod, the diameter of which is configured to enable the bolt rod to freely move in the elongated hole; a positioning member configured to be placed onto the bolt rod and to be received in one of the connection positions of the elongated hole, wherein the positioning member can be positioned in this connection position by the protrusions defining this connection position; and a nut configured to be screwed onto the bolt rod and to fasten the positioning member in the elongated hole.

In such embodiment, the adjustment of the mechanical tilt angle can be particularly simple. Firstly, loosen the nut and remove the positioning member from the elongated hole. Next, pivot the base station antenna arrangement such that the adjustment arm moves relative to the bolt until the bolt reaches another predetermined connection position of the elongated hole, and then screw the nut so that the positioning member is fastened in the other connection position.

In some embodiments, the positioning member may be a sleeve member separate from the nut. In some alternative embodiments, the positioning member and the nut may form a monolithic component. Therefore, the number of parts can be reduced, and the adjustment of the mechanical tilt angle can be further simplified.

In some embodiments, the bolt connection device may further include a lock nut. By loosening the nut, it is possible to ensure a tight connection with the aforementioned nut.

In some embodiments, the antenna mounting device may include a motion limiting member in the other end region of the two end regions of the base station antenna arrangement, which is configured to be mounted to the pole by a clamp and to limit a mechanical tilt angle range of the base station antenna arrangement. Consequently, when the mechanical tilt angle is adjusted, excessive pivoting of the base station antenna arrangement and potential resulting safety risks may be prevented.

In some embodiments, the middle region may have a longitudinal extension of a maximum of ⅙ of the longitudinal extension of the base station antenna arrangement. For example, it can be set approximately at the center point.

In some embodiments, the connection of the adjustment arm with the base station antenna arrangement may be located in an upper end region of the base station antenna arrangement.

According to another aspect of the present disclosure, a base station antenna system is proposed. The base station antenna system includes a base station antenna arrangement and an antenna mounting device according to the present disclosure, wherein the antenna mounting device is configured to mount the base station antenna arrangement to a pole.

The beneficial effects described for the antenna mounting device are also applicable to the base station antenna system.

In some embodiments, the base station antenna arrangement has a mounting frame and at least two base station antennas mounted to the mounting frame one after the other in a longitudinal extension of the mounting frame, wherein the antenna mounting device is configured for connection with the mounting frame.

In some other embodiments, the base station antenna arrangement may only include a single base station antenna. In some other embodiments, the base station antenna arrangement may include at least two base station antennas arranged side by side in a lateral direction.

In some other embodiments, the base station antenna arrangement may not have a mounting frame.

It should be pointed out here that the individual technical features mentioned in this article can be combined with one another arbitrarily, as long as the combined technical features are not mutually contradictory. All feasible feature combinations are the technical content included in this article.

BRIEF DESCRIPTION OF THE DRAWINGS

Specific embodiments of the antenna mounting device and base station antenna system according to the present disclosure are described below with reference to the attached drawings.

Among them.

EMBODIMENTS OF THE INVENTION

The present disclosure will be described below with reference to the attached drawings, which show the embodiments of the present disclosure. However, it should be understood that the present disclosure can be presented in many different ways and is not limited to the specific embodiments described below. In fact, the specific embodiments described below are intended to make the disclosure of the present disclosure more complete, so that those of ordinary skill in the art can fully understand the protection scope of the present disclosure. It should also be understood that the embodiments disclosed in the present disclosure may be combined in various ways to provide more additional embodiments.

It should be understood that the terms used in the Specification are only used to describe specific embodiments and are not intended to limit the present disclosure. Unless otherwise defined, all terms used in the Specification, including technical terms and scientific terms, have the meanings commonly understood by those of ordinary skill in the art. For brevity or clarity, well-known functions or structures may not be further described in detail.

Figure 1:
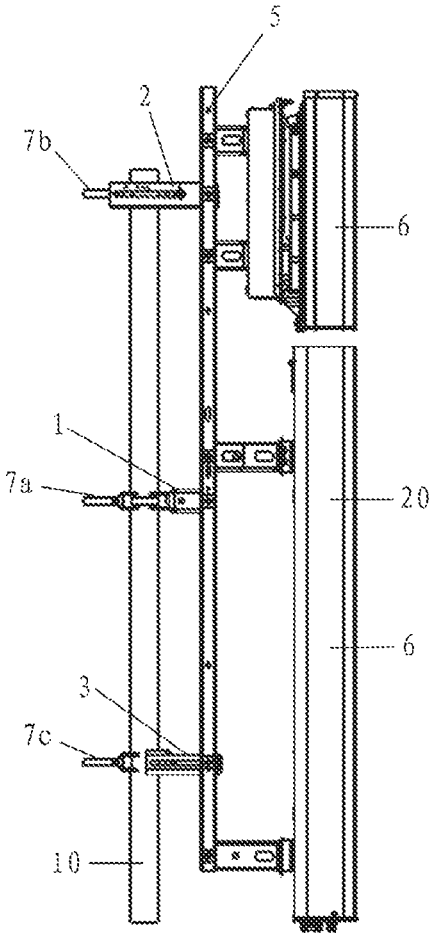
FIG. 1 is a side view of an antenna mounting device and a base station antenna system in a mounted state according to an embodiment of the present disclosure.
Figure 2:
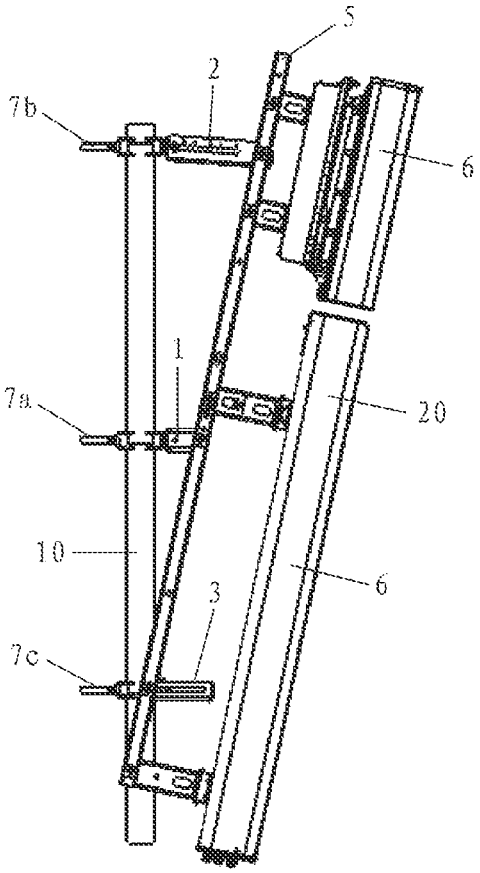
FIG. 2 is a side view of the antenna mounting device and base station antenna system of FIG. 1 in another mounted state.

FIG. 1 is a side view of an antenna mounting device and a base station antenna system in a mounted state according to an embodiment of the present disclosure, wherein the base station antenna system includes the antenna mounting device. FIG. 2 is a side view of the antenna mounting device and base station antenna system of FIG. 1 in another mounted state. The difference between the two mounted states is basically that the mechanical tilt angle of the base station antenna arrangement 20 is different. In the mounted state shown in FIG. 1, the base station antenna arrangement 20 is not inclined toward the ground, but is substantially parallel to the pole 10 or substantially parallel to the ground, while in the mounted state shown in FIG. 2, the base station antenna arrangement 20 is inclined at an angle toward the ground.

The base station antenna arrangement 20 may include one or more base station antennas 6. As shown in FIGS. 1 and 2, the base station antenna arrangement 20 may include two base station antennas 6, which are arranged one after another in the longitudinal direction. It goes without saying that it is also possible that more base station antennas are arranged one after another in the longitudinal direction, or other base station antennas or other electrical or electronic devices can be additionally arranged beside two base station antennas arranged one after another.

As shown in FIGS. 1 and 2, the base station antenna arrangement 20 may further include a mounting frame 5 having a first side and a second side opposite to the first side.

For example, the mounting frame 5 may include two longitudinal beams spaced apart from each other and a plurality of cross beams connecting the longitudinal beams. The mounting frame 5 may be configured such that it is fixed to the base station antenna 6 on the first side, and mounted on a pole 10 by an antenna mounting device on the second side. The antenna mounting device can be mounted on the pole 10 by clamps 7*a*-7*c*. In some embodiments, the clamp can be regarded as an integral part of the antenna mounting device. In some other embodiments, the clamp may not be regarded as an integral part of the antenna mounting device, and may be provided separately from the antenna mounting device.

The antenna mounting device may include a hinge device 1 configured to be mounted to the pole 10 by a clamp 7*a* and configured to pivotally connect the base station antenna arrangement 20. Therefore, the hinge device 1 provides a pivot point of the base station antenna arrangement 20. The connection point of the hinge device 1 and the base station antenna arrangement 20 may be set to be approximately at the center point of the longitudinal extension of the base station antenna arrangement 20.

Compared with prior art, the base station antenna arrangement 20 can be rotated around the pivot point more easily when the mechanical tilt angle of the base station antenna arrangement 20 is adjusted.

The antenna mounting device may include an adjustment arm 2 configured to be mounted to the pole 10 by a corresponding clamp 7*b* and configured to connect the base station antenna arrangement 20. A connection of the adjustment arm 2 with the base station antenna arrangement 20 may be located in one of two end regions of the base station antenna arrangement 20. In the embodiments shown in FIGS. 1 and 2, the adjustment arm may be arranged in the upper end region. In an embodiment not shown, the adjustment arm can also be arranged in the lower end region. The adjustment arm can be configured to be significantly more compact than the adjustment device of the prior art. In the case of the same pivot angle, the effective length of the adjustment device can be about half compared with the pivot point provided in the bottom region of the prior art, due to the centrally provided pivot point.

The adjustment arm 2 may have a plurality of connection positions for the corresponding clamp 7*b*, which are configured to define a plurality of different mechanical tilt angles at which the base station antenna arrangement 20 pivots about the hinge device 1.

Figure 3:
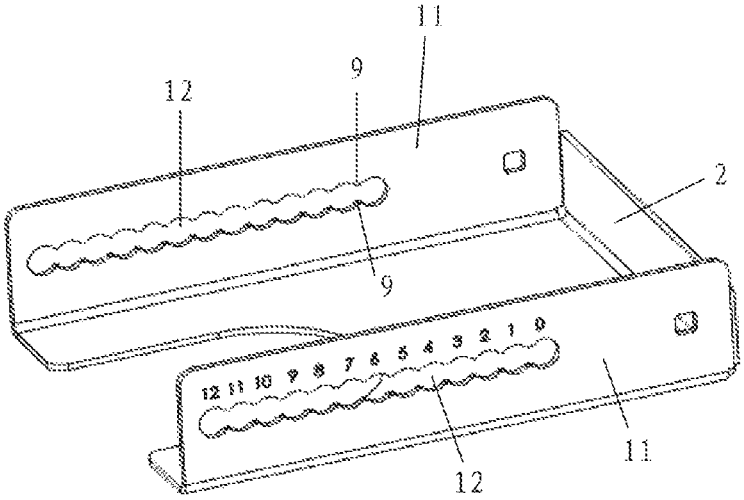
FIG. 3 is a perspective view of an adjustment arm of the antenna mounting device of FIG. 1.

FIG. 3 shows a perspective view of an embodiment of the adjustment arm 2. The adjustment arm 2 may have two side walls 11 spaced apart from each other, with each side wall having an elongated hole 12. The elongated hole may have protrusions 9 distributed on at least one longitudinal side thereof, particularly on two longitudinal sides thereof, which divide the elongated hole 12 into the plurality of connection positions. In some embodiments that are not shown, the plurality of connection positions may also be configured as a plurality of mounting holes spaced apart from each other. As shown in FIG. 3, each connection position can be provided with a scale or any other mark.

Figure 4:
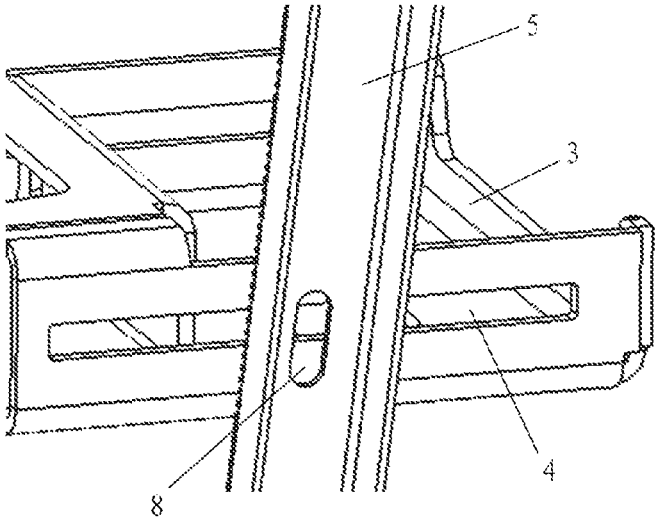
FIG. 4 is a partial perspective view of the antenna mounting device of FIG. 1.

FIG. 4 is a partial perspective view of the antenna mounting device of FIG. 1. As shown in FIG. 4, the antenna mounting device may additionally have a motion limiting member 3 configured to be mounted to the pole 10 by a corresponding clamp 7*c* and to limit the mechanical tilt angle range of the base station antenna arrangement 20. Therefore, when adjusting the mechanical tilt angle, the base station antenna arrangement 20 can only pivot within a predetermined angle range, and will not pivot too much to cause safety risks or accidents. As shown in FIG. 4, the motion limiting member 3 may have a first elongated hole 4. The mounting frame 5 of the base station antenna arrangement 20 may have a second elongated hole 8. The bolt pin can be inserted into the first elongated hole 4 and the second elongated hole 8 to limit the pivot angle range of the base station antenna arrangement 20.

Figure 5:
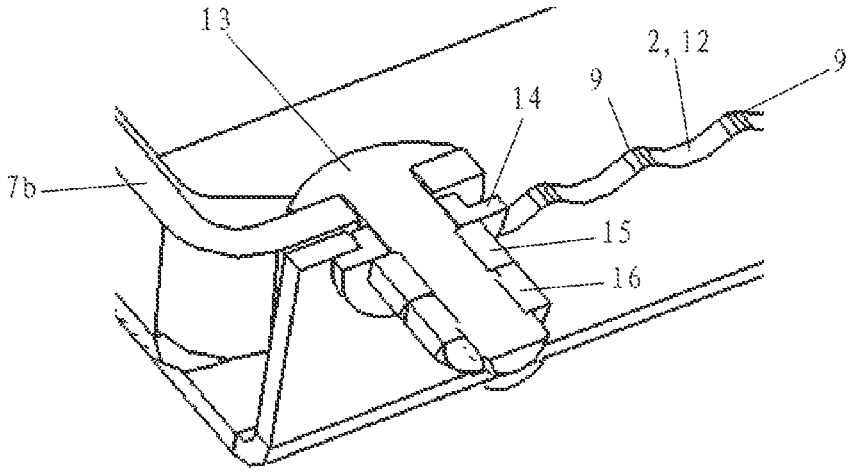
FIG. 5 is a perspective cross-sectional view of an embodiment of a connection device for an adjustment arm.
Figure 6:
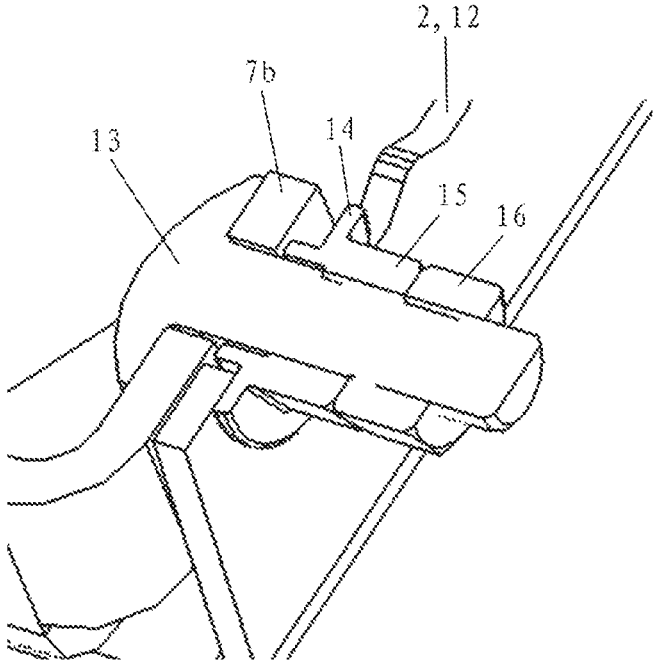
FIG. 6 is a perspective cross-sectional view of another embodiment of a connection device for an adjustment arm.

FIG. 5 is a perspective cross-sectional view of an embodiment of a connection device for an adjustment arm, wherein the connection device is configured as a bolt connection device. In some embodiments not shown, the connection device may also be a pinhole connection device, a rivet connection device, or even a welded connection structure that can be removed upon damage. Each side wall 11 of the adjustment arm 2 can be connected to the corresponding clamp 7*b* in one of the connection positions of the elongated hole 12 by a separate bolt connection device. The bolt connection device may include a bolt 13, wherein the diameter of the bolt rod is configured to enable the bolt rod to freely move in the elongated hole 12. The bolt connection device may include a positioning member 14 configured to be placed onto the bolt rod and to be received in one of the connection positions of the elongated hole 12, wherein the positioning member can be positioned in this connection position by the protrusions defining this connection position. The bolt connection device may include a nut 15 configured to be screwed onto the bolt rod and to fasten the positioning member 14 in the elongated hole 12. The difference between the embodiment of FIG. 5 and the embodiment of FIG. 6 is that in the embodiment shown in FIG. 5, the member 14 is a sleeve member separate from the nut 15, while in the embodiment shown in FIG. 6, the positioning member 14 and the nut 15 form a monolithic component. In addition, the bolt connection device may further include a lock nut 16 to prevent accidental loosening of the nut 15.

When the mechanical tilt angle of the base station antenna arrangement 20 needs to be adjusted, the lock nut 16 and the nut 15 can be loosened first, so that the positioning member 14 moves along the bolt rod away from the elongated hole 12; thereafter, the base station antenna arrangement 20 can be pivoted such that another predetermined connection position of the elongated hole 12 reaches the bolt 13; finally, the positioning member 14 can be moved along the bolt rod into the elongated hole again and be fastened in the other predetermined connection position.

It should be noted that the terminology used here is only for the purpose of describing specific aspects, and not for limiting the disclosure. The singular forms "a" and "the one" as used herein shall not exclude plural forms, unless the context explicitly states otherwise. It can be understood that the terms "including" and "inclusive" and other similar terms, when used in the application documents, specify the existence of the stated operations, elements and/or components, and do not exclude the existence or addition of one or more other operations, elements, components and/or combinations thereof. The term "and/or" as used herein includes all of any combinations of one or more relevant listed items. In the description of the attached drawings, similar reference numerals always indicate similar elements.

The thickness of the elements in the attached drawings may be exaggerated for clarity. In addition, it can be understood that if an element is referred to as being on, coupled to, or connected to, another element, then the said element may be directly formed on, coupled to, or connected to the other element, or there can be one or more intervening elements between them. Conversely, if the expressions "directly on", "directly coupled to" and "directly connected to" are used herein, it means that there are no intervening elements. Other words used to describe the relationship between elements should be interpreted similarly, such as "between" and "directly between", "adjacent" and "directly adjacent" and so on.

Terms such as "top", "bottom", "upper", "lower", "above", "below", etc. herein are used to describe the relationship of one element, layer or region with respect to another element, layer or region as shown in the attached drawings. It can be understood that in addition to the orientations described in the attached drawings, these terms should also include other orientations of the device.

It can be understood that although the terms "first", "second", etc. may be used herein to describe different elements, these elements should not be limited by these terms. These terms are only used to distinguish one element from another. Therefore, the first element can be referred to as the second element without departing from the teachings of the concept of the present disclosure.

Finally, it should be pointed out that the aforementioned embodiments are only used to understand the present disclosure, and do not limit the protection scope of the present disclosure. For those of ordinary skill in the art, modifications can be made on the basis of the aforementioned embodiments, and these modifications do not depart from the protection scope of the present disclosure.

That which is claimed:

1. An antenna mounting device including a hinge device configured to be mounted to a pole by a clamp and configured to pivotally connect a base station antenna arrangement, characterized in that the antenna mounting device includes an adjustment arm configured to be mounted to the pole by a clamp and configured to connect the base station antenna arrangement, wherein a connection of the hinge device with the base station antenna arrangement is located in a middle region of a longitudinal extension of the base station antenna arrangement having a longitudinal extension of a maximum of ⅓ of the longitudinal extension of the base station antenna arrangement, and a connection of the adjustment arm with the base station antenna arrangement is located in one of two end regions of the base station antenna arrangement, wherein the adjustment arm has a plurality of connection positions for the corresponding clamp, which are configured to define a plurality of different mechanical tilt angles of the base station antenna arrangement about the hinge device.

2. The antenna mounting device as recited in claim 1, characterized in that the adjustment arm has a long hole having protrusions distributed in at least one of its longitudinal sides, which divide the long hole into the plurality of connection positions.

3. The antenna mounting device as recited in claim 2, characterized in that the long hole has protrusions opposite each other in two longitudinal sides thereof, wherein the protrusions in each longitudinal side are distributed uniformly.

4. The antenna mounting device as recited in claim 2, characterized in that the adjustment arm has two side walls spaced apart from each other, each side wall having the long hole.

5. The antenna mounting device as recited in claim 4, characterized in that each side wall is connected with the corresponding clamp in one of the connection positions of the long hole by a separate connection device.

6. The antenna mounting device as recited in claim 5, characterized in that the connection device includes a positioning member that is movable into and out of one of the connecting positions of the long hole, wherein the adjustment arm is connected with the corresponding clamp when the positioning member moves into this connecting position, and the adjustment arm is released from the corresponding clamp when the positioning member moves out of this connecting position.

7. The antenna mounting device as recited in claim 5, characterized in that the connection device is a bolt connection device including:

a bolt with a bolt rod, the diameter of which is configured to enable the bolt rod to freely move in the long hole;

a positioning member configured to be placed onto the bolt rod and to be received in one of the connection positions of the long hole, wherein the positioning member can be positioned by the protrusions defining this connection position; and a nut configured to be screwed onto the bolt rod and to fasten the positioning member in the long hole.

8. The antenna mounting device as recited in claim 7, characterized in that the positioning member is a sleeve member separate from the nut.

9. The antenna mounting device as recited in claim 7, characterized in that the positioning member and the nut are a monolithic component.

10. The antenna mounting device as recited in claim 7, characterized in that the bolt connection device further includes a lock nut.

11. The antenna mounting device as recited in claim 1, characterized in that the antenna mounting device includes a motion limiting member in the other end region of the two end regions of the base station antenna arrangement, which is configured to be mounted to the pole by a clamp and to limit a mechanical tilt angle range of the base station antenna arrangement.

12. The antenna mounting device as recited in claim 1, characterized in that the middle region has a longitudinal extension of a maximum of ⅙ of the longitudinal extension of the base station antenna arrangement.

13. The antenna mounting device as recited in claim 1, characterized in that the connection of the adjustment arm with the base station antenna arrangement is located in an upper end region of the base station antenna arrangement.

14. A base station antenna system including a base station antenna arrangement, characterized in that the base station antenna system further includes an antenna mounting device as recited in claim 1, wherein the antenna mounting device is configured to mount the base station antenna arrangement to a pole.

15. The base station antenna system as recited in claim 14, characterized in that the base station antenna arrangement has a mounting frame and at least two base station antennas mounted to the mounting frame one after the other in a longitudinal extension of the mounting frame, wherein the antenna mounting device is configured for connection with the mounting frame.

* * * * *